United States Patent [19]

Watkins

[11] Patent Number: 4,613,848

[45] Date of Patent: Sep. 23, 1986

[54] MULTIPLE-ZONE INTRUSION DETECTION SYSTEM

[75] Inventor: Randy W. Watkins, Sun Valley, Calif.

[73] Assignee: Teletron Security, Inc., Tujunga, Calif.

[21] Appl. No.: 676,473

[22] Filed: Nov. 29, 1984

[51] Int. Cl.[4] ..... G08B 13/00; G08B 25/00

[52] U.S. Cl. ..... 340/541; 340/524; 340/825.36

[58] Field of Search ..... 340/541, 524, 525, 825, 340/36, 825.52, 825.08

[56] References Cited

U.S. PATENT DOCUMENTS

| | | | |
|---|---|---|---|
| Re. 29,068 | 12/1976 | Schopher et al. | 340/524 |
| 3,482,243 | 12/1969 | Buchsbaum | 340/524 |
| 3,927,404 | 12/1975 | Cooper | 340/413 |
| 4,206,449 | 6/1980 | Galvin et al. | 340/505 |
| 4,310,835 | 1/1982 | Sefton | 340/524 |

*Primary Examiner*—Glen R. Swann, III

*Attorney, Agent, or Firm*—John T. Matlago

[57] ABSTRACT

A central controller is connected by a common two-wire communication cable to a plurality of remote zone transponders. Each zone transponder includes a counting means and a resistive network having a detecting sensor therein. The central controller includes pulse generating means for generating control pulses and address pulses, and an analog-to-digital converter means. A gate enabled by the control pulses passes the address pulses onto the communication cable for supplying power to and incrementing the counting means in each of the zone transponders to sequentially render the resistive network in each operable to transmit a responsive current on the communication cable back to the central controller where the disabling of the gate by the absence of a control pulse permits the analog-to-digital converter means to receive the responsive current from the resistive network of each of the zone transponders and convert it into a digital signal indicative of the status of the detecting sensor therein.

21 Claims, 7 Drawing Figures

POWER SUPPLY
110 VAC
VCC
PULSE GENERATOR
100 HZ OSCILLATOR
POWER AMP.
ANALOG TO DIGITAL CONVERTER
ZONE COUNTER/ DECODER
ZONE STATUS REGISTERS
ZONE STATUS DISPLAY
ZONE 10 TRANS-PONDER
ZONE 3 TRANS-PONDER
ZONE 2 TRANS-PONDER
ZONE 1 TRANS-PONDER
SENSOR

FRAME
FRAME

110 VAC
POWER SUPPLY
MC 146805 MICRO-PROCESSOR
POWER AMP.
GATE
1000 Hz OSCILLATOR
ZONE STATUS DISPLAY (a)
(b)
(c)
(d)
(e)
TIME

MULTIPLE-ZONE INTRUSION DETECTION SYSTEM

FIELD OF THE INVENTION

This invention relates to multiple-zone intrusion detection systems and more particularly to such a system that provides for transmitting signals from a plurality of remote zone sensors to a central controller indicative of the status thereof.

BACKGROUND OF THE INVENTION

In systems which provide for a plurality of remote zone sensors to be monitored at a central controller, a variety of techniques have been heretofore employed for communicating between the central controller and the remote zone sensors. In some of these systems, individual wire have been run from the central controller to each of the remote zones and, in others, a single two-wire communication cable has been used which may employ frequency or time division multiplexing. Although the use of a single two-wire communication cable is preferable because of the saving in wire and labor, the state of the art multiple-zone sensor intrusion detection systems of this type offset some of this saving by employing costly, bulky, and/or low performance zone transponders. It is highly desirable, therefore, to provide a multiple-zone intrusion detection system that utilizes a single two-wire communication cable wherein the zone transponders therefor are simple, small in size, have performance equal to individually wired zone sensors, and, yet, are relatively low in cost.

OBJECTS AND SUMMARY OF THE INVENTION

It is therefore an object of the present invention to provide an economical yet high performance system for transmitting information to a central controller over a single two-wire communication cable indicative of the status of each of a plurality of remote zone sensors.

It is a further object of the present invention to provide a time multiplexed communication system for determining the status of each of a plurality of remote zone sensors by returning an analog signal from each of the remote zones over a single two-wire communication cable to a central controller.

Another object of the present invention is to provide a relatively simple resistive network at each of a plurality of remote zone transponders which provides for sending an analog signal back to a central controller indicative of the status condition of a sensor at the zone.

Yet another object of the present invention is to provide for communicating between a central controller and a plurality of remote zone transponders by way of a single two-wire communication cable wherein each remote zone transponder is capable of simply sending back analog signals indicating not only whether the zone has been intruded upon but also whether the circuits at the remote zone are malfunctioning and the nature of the malfunctioning.

In accordance with the preferred embodiment of the present invention a central controller is connected to a single two-wire communication cable which extends through all the remote zones of an area to be protected against unlawful intrusion. At each of the remote zones, a transponder is connected across the single two-wire communication cable. The central controller includes pulse generator and amplifier means, and receiving circuit means in the form of an analog-to-digital converter. Each zone transponder includes a power capacitor, a counter/decoder provided with a unique count output lead, and a resistive network having a sensor switch therein. The pulse generator and amplifier means in the central controller provide for transmitting address pulses over the single two-wire communication cable which serve to charge the power capacitor in each of the zone transponders and cause the counter/decoder therein to advance its count in response to each address pulse. Each time the counter/decoder in a zone transponder reaches its unique count output, it provides for applying the voltage output of its power capacitor to energize its resistive network and cause current to be transmitted on the single two-wire communication cable back to the central controller. There the analog-to-digital converter is controlled to receive the current and provide a digital output indicative of the condition of the zone sensor of the transponder or a malfunctioning condition thereof.

These and other features, aspects and advantages of the present invention will become apparent from the detailed description thereof taken with the accompanying drawings.

BRIEF DESCRIPTION OF THE DRAWINGS

FIGS. 5*a* to 5*e* show the current charging response of the timing capacitor in the central controller for different status conditions of a zone transponder;

DETAILED DESCRIPTION OF THE INVENTION

Figures 1, 6:
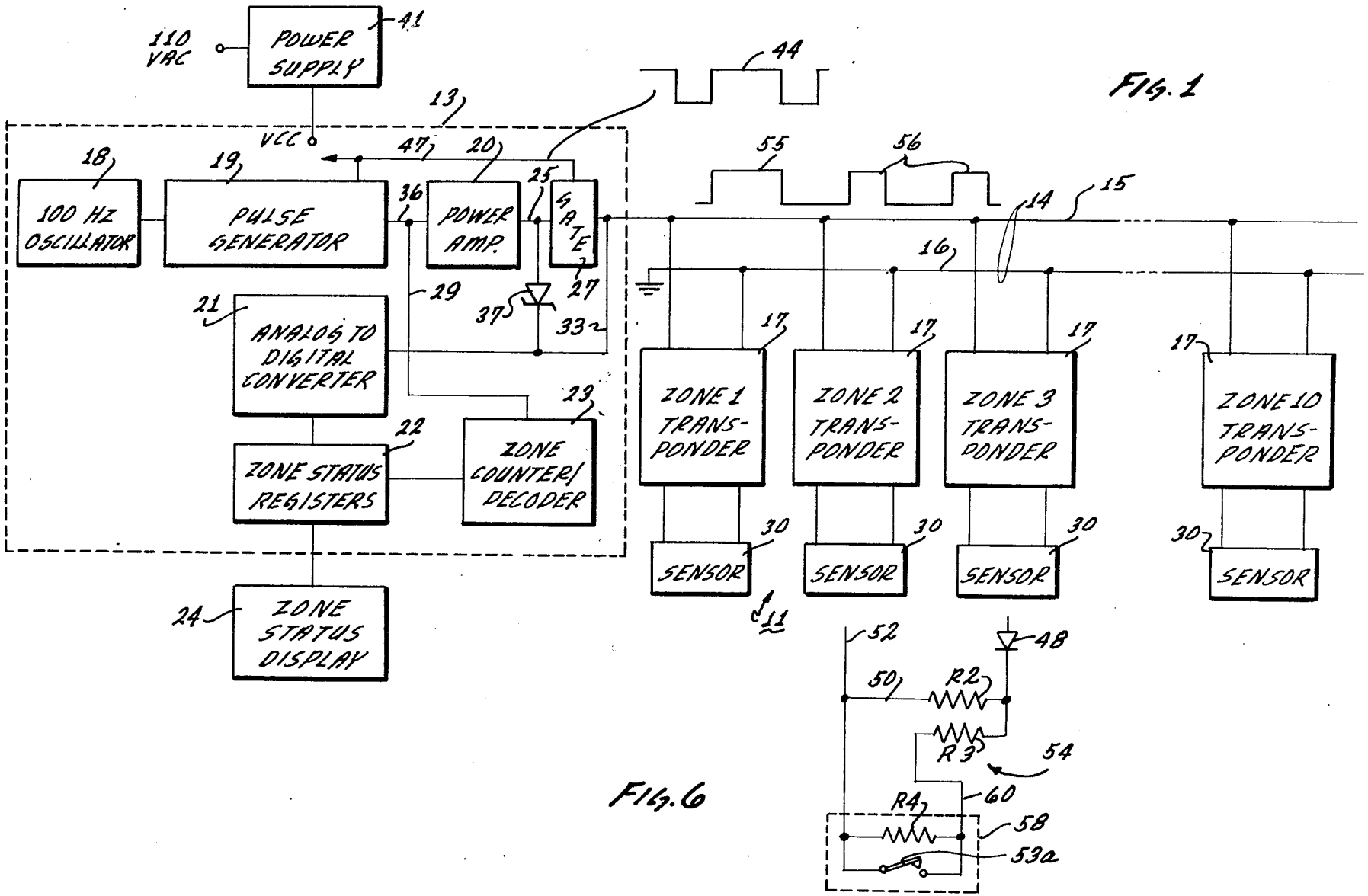
FIG. 1 is an overall block diagram of the multiple-zone intrusion detection system of the present invention.
FIG. 6 shows a modified resistive network for a zone transponder that includes a sensor having a normally-open switch therein.

Reference will first be made to FIG. 1 which shows an overall block diagram of a multiple-zone intrusion detection system 11 that includes a central controller 13 connected to a single two-wire communication cable 14 which extends through a plurality of remote zones to be protected. In each of the remote zones, a transponder 17 provided with a sensor 30 is connected in parallel across the pair of wires 15 and 16 comprising the communication cable 14. Wire 16 provides the negative power connection to each zone transponder 17 while wire 15 not only provides for conveying power from the central controller 13 to each of the zone transponders 17 but also provides a two-way communication between the central controller 13 and each of the zone transponders 17.

Figures 2, 5, 7:
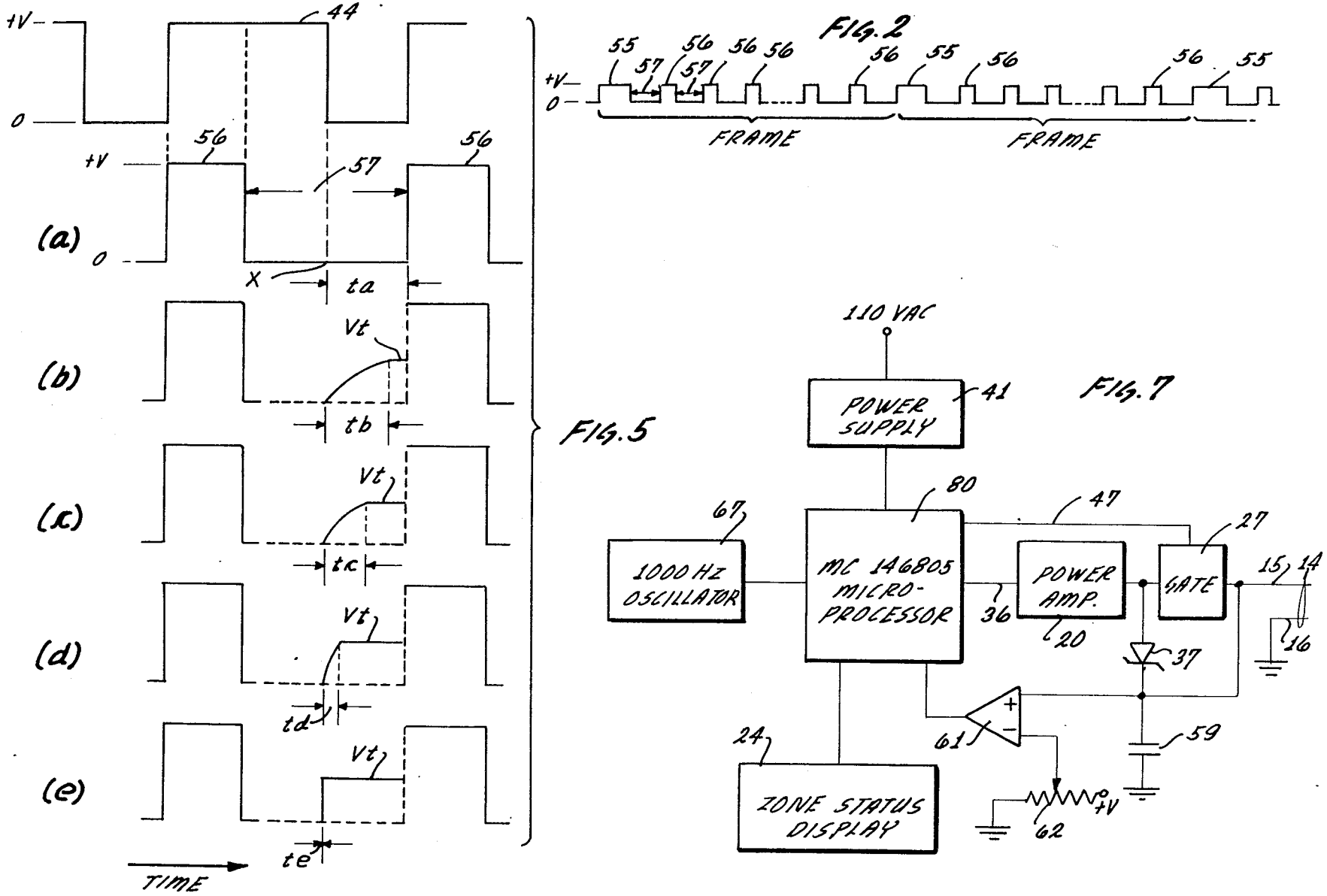
FIG. 2 shows the waveform of the address pulses supplied by the pulse generator.
FIG. 7 is an overall block diagram of another embodiment of the central controller wherein a microprocessor is provided for performing many of the functions thereof.

As shown in FIG. 1, the central controller 13, which is energized by a power supply 41, includes a 100 Hz oscillator 18, a pulse generator 19, a power amplifier 20, an analog-to-digital converter 21, zone status registers 22, and a zone counter/decoder 23. The 100 Hz oscillator 18 controls the operation of the pulse generator 19 to serially generate a fixed number of square wave address pulses each frame period, as shown in FIG. 2, the number of address pulses being equal to the number of zone transponders 17 in the system. These address pulses are fed on an output line 36 into the power amplifier 20, and then on line 25 through a gate 27 onto wire 15 of the communication cable 14. The pulse generator 19 also provides square wave control pulses 44 (FIG. 5) on an output line 47 which is connected to the control input of gate 27. The control pulses 44 on output line 47 are also connected to other circuits in the analog-to-digital converter 21, as will be described hereinafter.

As noted, the output line 36 of the pulse generator 19 is also connected by a lead 29 to the zone counter/decoder 23; and the wire 15 of communication cable 14, at the output of gate 27, is connected by a lead 33 to the analog-to-digital converter 21 in the central controller 13. A zener diode 37, connected across the output line 25 of power amplifier 20 and the lead 23, provides a clamping action on lead 33. Moreover, the zone counter/decoder 23 counts the address pulses on line 36 to provide outputs, identifying each of the addressed zone transponders 17, to the zone status registers 22 which store the digital outputs of the analog-to-digital converter 21.

As will be described hereinafter, the address pulses (FIG. 2) transmitted through the power amplifier 20 and gate 27 onto wire 15 of the communication cable 14 provide for supplying power to and incrementing a counter/decoder 34 in each of the zone transponders 17 (FIG. 3) to thereby provide for sequentially addressing the zone transponders 17 to cause each of them to transmit an analog signal indicative of the status of the zone back on the wire 15 to the analog-to-digital converter 21 in the central controller 13. There, the digital signal associated with each zone transponder 17, as identified in the central controller 13 by the zone counter/decoder 23, is stored in one of the zone status registers 22, and displayed on a zone status display 24 to provide a visual indication of the status of the zone sensor 30 in the zone.

Figure 3:
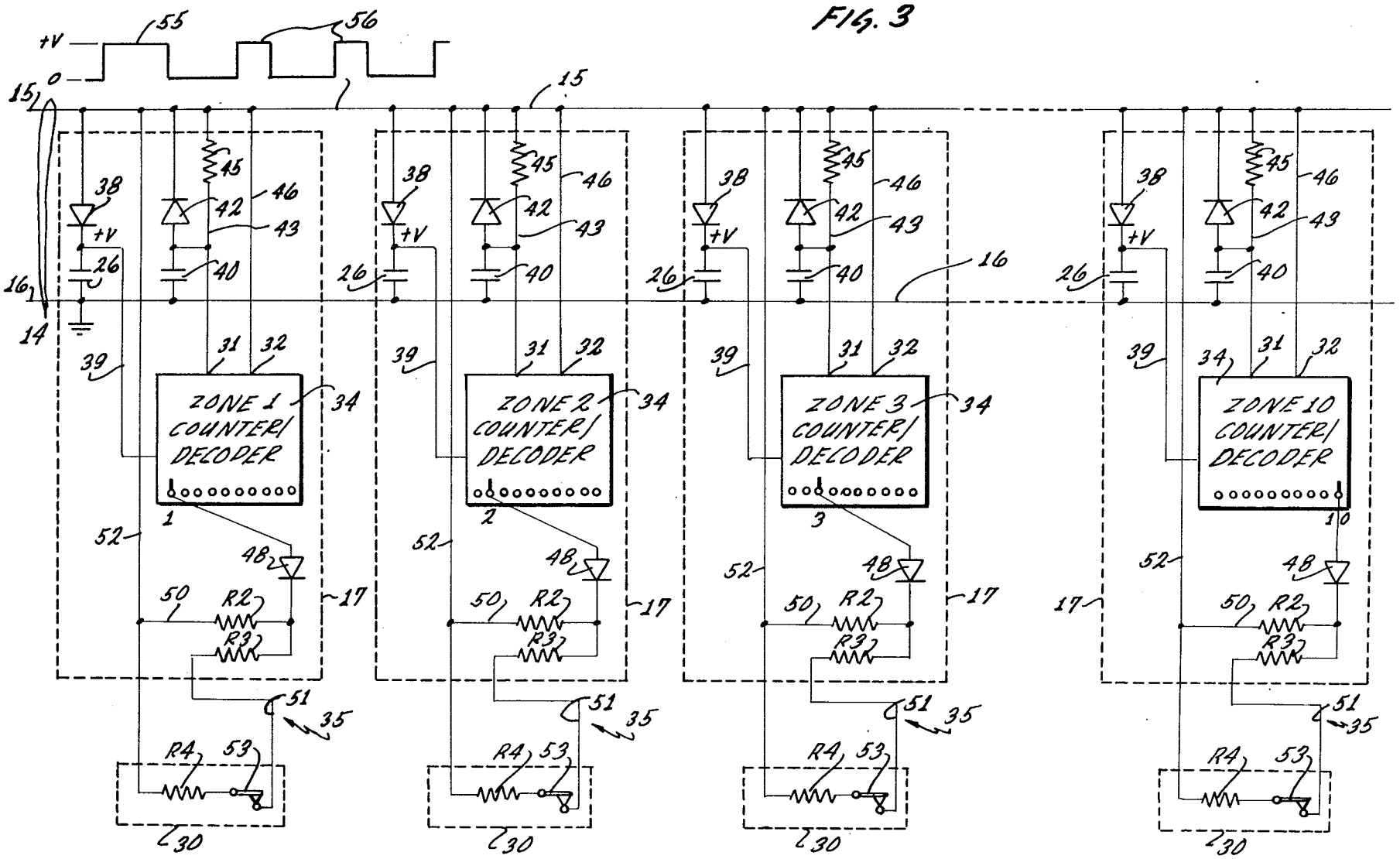
FIG. 3 is a more detailed showing of the zone transponder circuits.

Reference will next be made to FIG. 3 which is a more detailed showing of the circuits and components of the zone transponder 17. Thus, each zone transponder 17 includes a power capacitor 26, a counter/decoder 34 provided with a reset input 31 and a clock input 32, and a resistive network 35 including the sensor 30.

Each power capacitor 26 is connected between ground and the cathode of a diode 38 whose anode is connected to wire 15 of cable 14. The positive side of the power capacitor 26 is further connected by way of a lead 39 to supply a +V voltage to the counter/decoder 34. A reset circuit for the counter/decoder 34 includes a reset capacitor 40 connected between ground and the anode of a diode 42 whose cathode is connected to the wire 15. The positive side of the reset capacitor 40 is further connected to a lead 43 having one end connected by a resistor 45 to the wire 15 and having the other end connected to the reset input 31 of the counter/decoder 34. A lead 46 further connects the wire 15 directly to the clock input 32 of the counter/decoder 34.

Each counter/decoder 34 has its decoder arranged to provide a +V voltage on a unique count output of its counter to indicate that the zone transponder 17 of which it is a part is addressed. Thus, the counter/decoder 34 for the zone 1 transponder 17 is connected to provide a +V voltage on its count output 1, the counter/decoder 34 for the zone 2 transponder 17 is connected to provide a +V voltage on its count output 2, the counter/decoder 34 for the zone transponder 34 is connected to provide a +V voltage on its count output 3, etc.

The unique count output provided in the counter/decoder 34 of each of the zone transponders 17 is connected to the anode of a switching diode 48 whose cathode is connected to the input of the resistive network 35. Thus, in the zone 1 transponder 17, for example, the count output 1 of the counter/decoder 34 is connected to the anode of switching diode 48 and the cathode of the switching diode 48 is connected to the input of resistive network 35. Resistive network 35 includes two resistive paths 50 and 51 which join to a line 52 leading back to the wire 15. Resistive path 50 includes a single resistor R2, and path 51 includes, in series, a resistor R3, a normally-closed switch 53 and the supervisory resistor R4. The normally-closed switch 53 and the supervisory resistor R4 comprise the zone sensor 30.

When the +V voltage supplied by the power capacitor 26 to the resistive network 35 in a zone transponder 17 is equal to approximately 7 volts, typically the resistor R2 is equal to about 12 K ohms, the resistor R3 is equal to about 5.1 K ohms, and the resistor R4 is equal to about 22 K ohms.

Generally, the current which flows through resistor R2 in path 50 informs the central controller 13 that the zone transponder 17 is operating properly, and the current which flows through resistor R3 and resistor R4 informs the central controller 13 of the status of the path 51 and zone sensor 30. More particularly, the use of zone sensor resistor network 35 with resistors R2, R3 and R4 enables the central controller 13 to detect the following zone status conditions: a non-operational zone transponder, an intrusion of the zone, a good zone; a short across the sensor 30 of the zone; or a short across the wires 15 and 16 of cable 14.

It should now be clearly understood that each of the other zone transponders 17 is provided with the same circuits as described for the zone 1 transponder 17, the only difference being that the count output provided for the counter/decoder 34 in each is unique.

In the preferred embodiment of the multiple-zone intrusion detection system of the present invention, 10 zone transponders 17 are provided. Accordingly, as illustrated in FIG. 2, the pulse generator 19 provides for 10 address pulses to be supplied by the power amplifier 20 during each frame period. As noted, the first address pulse 55 in a frame is longer than the remaining address pulses 56 and is referred to as a synchronizing pulse. Moreover, the trailing edge of each address pulse is spaced from the leading edge of the next by a fixed period of time to define a polling interval 57. As will be explained hereinafter, it is during a polling interval 57 that follows an address pulse which identifies a zone transponder 17, that the zone transponder 17 sends back to the central controller 13 on the wire 15 a current indicating the status of the sensor 30 therein.

Referring next to FIGS. 2 and 3, when the first pulse, i.e., the synchronizing address pulse 55 in a frame, is applied on the wire 15 of cable 14, this pulse forward biases the diode 38 and charges the power capacitor 26 in each of the zone transponders 17 to provide the +V voltage on a lead 39 which is connected to the counter/decoder 34 in each zone transponder 17. The power capacitor 26 can supply the +V voltage to operate the counter/decoder 34 in the zone transponder 17 for several seconds. In addition, this synchronizing address pulse 55 conducts through the resistor 45 of the reset circuits in each of the zone transponders 17 to charge the reset capacitor 40 so as to provide a voltage at the reset input 31 of each of the counter/decoders 34 so as to simultaneously reset each of them to the one count. The diode 42 provides for discharging the reset capacitor 40 once the counter/decoder 34 is reset. It should be noted that the longer synchronizing address pulse 55 is able to charge the reset capacitor 40 to the voltage level as needed to reset the counter/decoder, whereas the remaining shorter address pulses 56 in a frame are not able to charge the reset capacitor 40 to such a voltage level. In any event, the synchronizing address pulse 55 resets the counter/decoder 34 of all of the zone transponders 17 to count one, and, thereafter, they all are simultaneously incremented by the leading edge of each of the address pulses 56 in the frame.

As will be explained hereinafter, when the +V voltage on the one count output of the counter/decoder 34 of the zone transponder 17, for example, is initially applied on the anode of switching diode 48; no current flows in the resistive network 35 since diode 48 is back biased by the address pulse 56 still present on wire 15. However, at the end of this address pulse 56, when the wire 15 is at 0 voltage, current flows through the resistive network 35 and through line 52 onto wire 15 back to the central controller 13.

Figure 4:
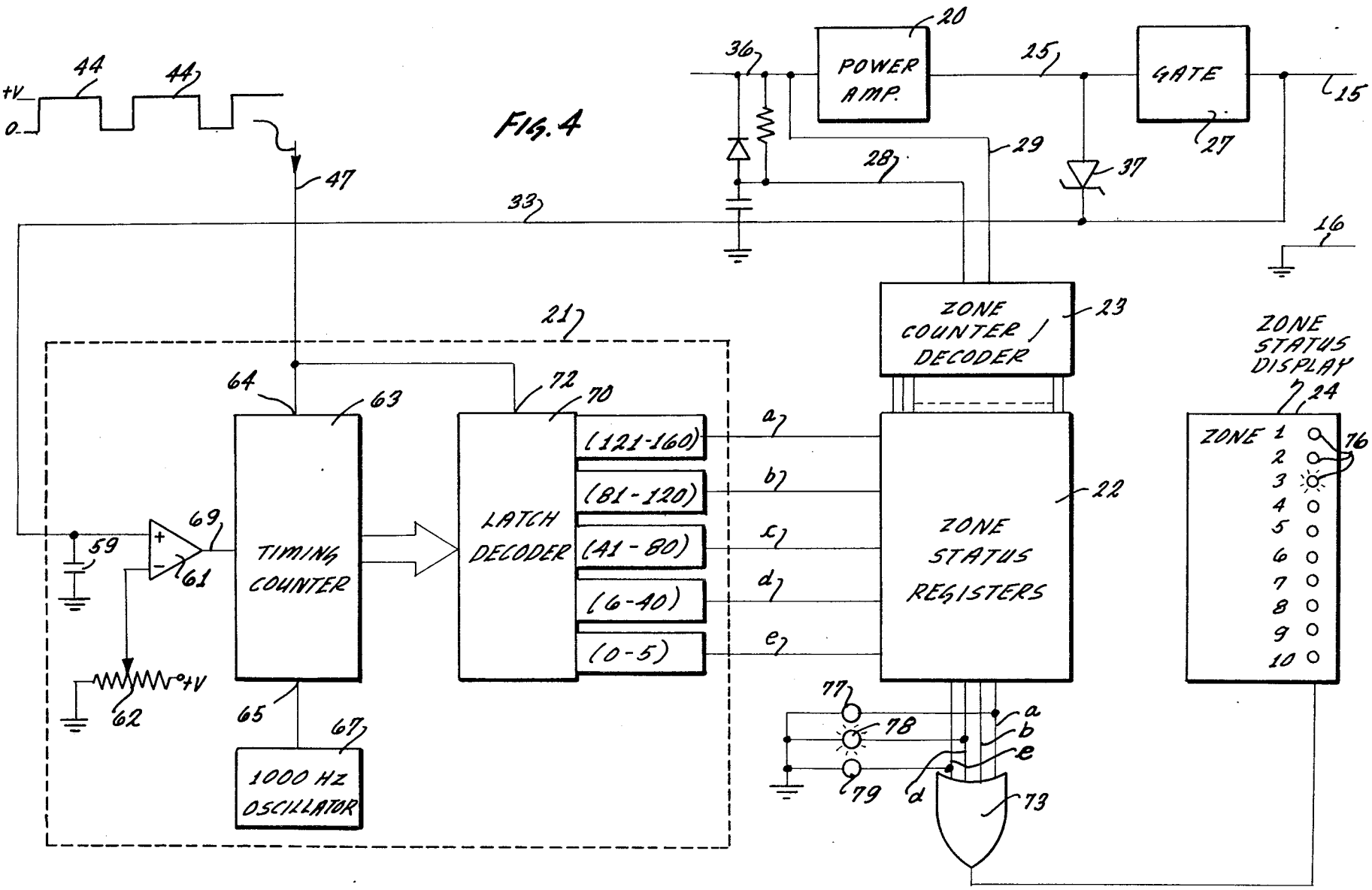
FIG. 4 is a more detailed showing of the circuits in the central controller.

Reference will next be made to FIG. 4 which shows in greater detail the circuits of the analog-to-digital converter 21 and the other components in the central controller 13. Thus, the analog-to-digital converter 21 includes a timing capacitor 59 having one side grounded and the other side connected to the lead 33 which connects wire 15 to the positive input of a comparator circuit 61. The negative input of the comparator 61 is connected through an adjustable potentiometer 62 to ground.

A timing counter 63 is provided with a reset input 64 connected to receive the same control pulses 44 being provided by pulse generator 19 (FIG. 1) on the line 47 to control the gate 27. Thus, when the line 47 connected to the reset input 64 of timing counter 63 is at 0 voltage indicating absence of a control pulse 44, the timing counter 63 counts timing pulses from a 1000 Hz oscillator 67 as received on its clock input 65. When the line 47 is at +V voltage, indicating presence of a control pulse 44, on the reset input 64, the timing counter 63 is reset to zero and is preventing from counting until the line 47 again returns to a 0 voltage. Thus, the timing counter 63 counts timing pulses received at its clock input 65 only during the time the reset input 64 is low in potential and the output 69 of the comparator circuit 61 is low in potential which latter will happen as long as the voltage on the negative input of the comparator circuit 61 is more positive than the voltage on the positive input thereof. Thus, at the instant that the timing capacitor 59 gets charged so as to provide a voltage on the positive input of comparator circuit 61 that is larger then the voltage on the negative input thereof, the timing counter 63 stops counting.

It should be noted that the control pulses 44 on line 47 are also fed into the enable input 72 of latch decoder 70. Thus, at the instant that the leading edge of a control pulse 44 swings to +V voltage it enables the flipflops of the latch decoder 70 to be set to the count existing at that time in the flipflops of the timing counter 63, following which the timing counter 63 is reset to zero.

As will be explained hereinafter, the timing capacitor 59 is controlled to receive the current that is flowing through the resistive network 35 of the addressed zone transponder 17 onto the wire 15 only during the last half of the polling interval 57 following the address pulse that causes the unique count output of the counter/decoder 34 for the zone transponder 17 to provide a high potential of +V voltage thereon. Thus, the timing capacitor 59 begins to be charged and simultaneously the timing counter 63 starts to count starting with the last half of the polling interval 57.

Reference will next be made to FIGS. 1 and 5 to explain the manner in which the central controller 13 controls the operation of the zone transponders 17 and the analog-to-digital converter 21 so as to provide an analog signal at the central controller 13 indicative of the status of a zone transponder 17 that has been addressed by an address pulse 56.

Thus the waveform in FIG. 5*a* shows successive address pulses 56 defining a polling interval 57. A control pulse 44, as provided on output line 47 from the pulse generator 19, is positioned above the waveform in FIG. 5*a* to show the time relationship of the control pulses 44 to the address pulses 56.

First to be noted is that the leading edge of the control pulse 44 is aligned with the leading edge of the address pulse 56. However, control pulse 44 is longer in duration in that its trailing edge is located substantially at point X in the middle of the polling interval 57 defined by the time between successive address pulses 56.

Thus when the leading edges of the control pulses 44 swing to a high +V voltage they enable the gate 27 (FIG. 1) and permit the synchronizing address pulse 55 and the following address pulses 56 in each frame to be applied on the wire 15 for transmittal to the zone transponder 17. Now the power amplifier 20 always provides a low impedance on wire 15 when gate 27 is enabled by the +V voltage of control pulse 44. Thus, as shown in FIG. 5*a*, although the impedance on wire 15 is low during the first half of a polling interval 57 because the gate is enabled, the impedance thereon is high during the last half of the polling interval 57 because the gate 27 is disabled.

Now the arrangement is such that during the first half of the polling interval 57, the timing capacitor 59, which is connected to wire 15 by lead 33 (FIG. 4), is able to discharge through the enabled gate 27 into the low impedance of power amplifier 20 and when the impedance on wire 15 is high during the last half of a polling interval 57, because of the disabling of gate 27, the timing capacitor 59 is able to be charged by the current on wire 15 as received from the resistive network 35 of an addressed zone transponder 17.

It should be appreciated that it is especially important that the wire 15 does not exceed a threshold voltage level Vt thereon during this response time that could cause any of the counter/decoders 34 in the zone transponders 17 to be erroneously incremented as though the swing to this voltage level were a clocking input.

It is for this reason that the zener diode 37 (FIG. 4) is connected between the output line 25 of power amplifier 20 and the lead 33. Thus, as indicated in FIG. 5*b*, for example, when the current received on wire 15 from the resistive network 35 of an addressed zone transponder 17 provides for charging the timing capacitor 59 to a voltage at which the zener diode 37 breaks down, the line 33 is clamped and the remainder of the current flow on wire 15 is dissipated into the low impedance power amplifier 20. The clamping voltage level of the zener diode 37 may for all practical purposes be also considered the threshold level of the comparator circuit 61 as long as the clamping voltage level is slightly larger than the threshold level of the comparator circuit. Thus the zener diode 37 effectively clamps the voltage charge on the timing capacitor 59 to the threshold level Vt which assures that the timing capacitor 59 can be charged to a level to stop the timing counter 63 and also assures that the counter/decoders 34 in the zone transponders 17 will not be erroneously incremented.

As previously described, when the +V voltage is first gated onto the count output 1 of the counter/decoder 34 of the zone 1 transponder 17, for example, it is applied immediately on the anode of the switching diode 48. However, the address pulse 56 is still present on wire 15, resulting in diode 48 being back biased such that no current flows in the resistance network 35 until the start of the polling interval 57. Moreover, during the first half of the polling interval 57, the gate 27 is enabled and, accordingly, the current on the wire 15 from resistor network 35 is discharged into the low impedance power amplifier 19. Thus, it is not until the middle of the polling interval 57, as indicated by point X in FIG. 5*a*, that the gate 27 is disabled and places a high impedance on wire 15. As a result, referring to FIG. 4, it is not until this instant that the current flowing through the resistive network 35 on wire 15 into the central controller 13 provides for charging timing capacitor 59.

The current flowing through the resistive network 15 charges the timing capacitor 59 in the analog-to-digital converter 21 at a rate, depending on the RC circuit time response thereof, to a threshold level Vt at which it is more positive then the negative input of the comparator circuit 61, as determined by the setting of the adjustable potentiometer 62. At that instant, the output 69 of the comparator circuit 61 switches to a high voltage level, i.e., disables the timing counter 63 from further counting timing pulses from the 1000 Hz oscillator 67. In other words the timing counter 63 times how long it takes the timing capacitor 59 to be charged by the current flow from the resistive network 35 of the addressed zone transponder 17 to the level at which its voltage exceeds the voltage on the negative input of the comparator circuit 61. Thus, if the overall resistance of the resistive network 35 changes due to the normally closed switch 53 opening up so as to remove path 51, or, due to a malfunctioning, such as a short across the sensor 30, for example, the current flow will either be greater or less through the resistive network 35 and onto wire 15 to charge the timing capacitor 59 and, as a result, the timing counter 63 will be stopped either sooner or later.

When a control pulse 44 is present on the reset input 64 of the timing counter 63 it resets and holds the timing counter 63 in an off condition until the middle point X of the polling interval 57 at which time the timing counter 63 starts to count simultaneously with the wire 15 being provided with a high impedance, as a result of gate 27 being disabled by the termination of each control pulse 44 on lead 47, thereby enabling current being received on wire 15 from the resistive network 35 of an addressed zone transponder 17 to start to charge the timing capacitor 59 in the analog-to-digital converter 21.

Each control pulse 44, upon terminating, disables the gate 27 and releases the power amplifier 20 from wire 15, that is, places a high impedance on wire 15 so that the timing capacitor 59 can start to be charged by the current supplied on wire 15 by the resistive network 35 of the addressed zone transponder 17. Moreover, the control pulse 44, upon terminating, simultaneously provides for enabling the timing counter 63 to start to count timing pulses from the 1000 Hz oscillator 67.

During the time the timing counter 63 is counting the latched decoder 70 is unaffected. When the comparator circuit 61 output voltage on input 69 to the timing counter 63 swings to a high potential, the timing counter 63 stops. Now the leading edge of a control pulse 44 applied on line 47 to the reset input 64 of the timing counter 63, which resets it to zero, also is applied onto the enable input 72 of latch decoder 70 and causes the flipflops therein to be set in accordance with the count reached by the flipflops on the timing counter 63 during the polling interval 57. Thus, by the time the timing counter 63 is reset by the leading edge of a control pulse 44, the count setting of the flipflops in the timing counter 63 has already been transferred to the flipflops in the latch decoder 70 which decodes the setting to provide a count output. This count output is held until a new output count is provided in the timing counter 63 during the next polling interval.

It should now be clear that if the zone transponder is non-operational for some reason, or if the wires 15 and 16 of cable 14 are shorted, no current will flow into the wire 15 from resistive network 35; if the sensor normally-closed switch 53 is open, current can flow through only the resistor R2; if the sensor normally-closed switch 53 is closed, current can flow through resistors R2, R3 and R4; if the sensor 30 is shorted, by its terminals being twisted, for example, current will flow through resistor R2 and R3 but not through resistor R4; and, if wire 15 of cable 14 is shorted to a positive voltage source, current will continually flow and maintain timing capacitor 59 at the fully charged voltage threshold level of Vt. Supervisory resistor R4, connected in series with the normally-closed switch 53 provides for supervising switch 53 in the event of tampering with path 51.

Thus, depending on the status of the current paths comprising resistive network 35, which determine the quantity of current flowing therein during the last half of a polling interval 57, the timing counter 63 can have any of a number of counts therein when it stops, which count, when decoded by the latch decoder 70, will energize one of the following range of output counts: (121–160), (81–120), (41–80), (6–40) or (0–5). Each range of output counts corresponds to a different status of the zone transponder and such ranges are provided to enable low cost resistors and other circuit components to be used. Thus, although the quantity of current being sent back to the central controller 13 indicative of the status of the respective zones may vary, as a result of the use of such wide tolerance components, it can still be properly interpreted by fitting within the wide ranges provided therefor.

The different status conditions of the resistive network 35 of the preferred embodiment of the detection system that can be recognized during a polling interval 57 by the analog-to-digital converter 21 in the central controller 13 are depicted in FIGS. 5*a* to 5*e*.

Thus, assume, as illustrated in FIG. 5*a*, that for some reason the resistive network 35 in a particular zone is dead, i.e., non-operational, or that wires 15 and 16 of cable 14 are shorted, so that at the midpoint X of a polling interval 57, no return current starts to flow. Such a dead zone may be the result of, for example, the circuits of the resistive network 35 having been cut or inadvertently damaged. Now, if there is no current flowing (FIG. 5*a*), the timing capacitor 59 will never charge up. As a result, the output of timing capacitor 59 is always at a low voltage and the output 69 of comparator circuit 61 is always low in potential. Consequently the timing counter 63 virtually continually counts throughout the last half of polling interval 57, as indicated by time interval ta, and a high voltage output on line a of the latch decoder 70 will be indicated if the count output of the timing counter 63 is anywhere within the range of (121–160) so as to indicate this status.

Next assume, as illustrated in FIG. 5*b*, that the sensor normally-closed switch 53 in a zone has been opened by an intruder and current is flowing only through the first path 50 containing the resistor R2 to the lead 52 connected to the wire 15. As a result of such a high resistance in network 35 a relatively small amount of current flows therethrough to charge timing capacitor 59 and, consequently, the timing counter 63 is able to count for a relatively long period of time, as indicated by time interval tb, to provide a large count output on output line b for the latch decoder 70 in the range of (81–120). This status condition indicates the zone is intruded upon. Note that the voltage charge on the timing capacitor 59 is clamped at voltage Vt by the zener diode 37.

Next assume, as illustrated in FIG. 5*c*, that the sensor normally-closed switch 53 in a zone remains closed and that at the midpoint of a polling interval 57 current starts to flow in network 35 both through the first path 50 containing resistor R2 and through the second path 51 containing series resistors R3 and R4 and on to the lead 52 connected to wire 15. Because of the second path 51 being present in the network 35, a relatively smaller amount of overall resistance is present in the network and consequently a larger amount of current flows through network 35 and so the timing capacitor 59, as indicated by tc, takes a shorter period of time to charge to the threshold level Vt with the result that the timing counter 63 is only able to provide the short count output on the output line c of the latch decoder 70 in the range of (41–80). This status condition indicates the zone is good, i.e., non-intruded upon.

Next assume, as illustrated in 5*d*, that the supervisory resistor R4 in the sensor is bypassed, i.e., shorted, such that at the midpoint of a polling interval 57, current flows through resistor R2 in path 50 and only resistor R3 in path 51. This reduces the overall resistance in network 35 even more and enables a larger quantity of current to flow therethrough, that is, the current need only flow for a relatively shorter period, as indicated by td, before it charges the timing capacitor 59 to the threshold level Vt at which it exceeds the negative input to the comparator circuit 61 and stops the timing counter 63 and thereby provides a count output on output line d of latch decoder 70 in the range of (6–40).

Finally assume, as illustrated in FIG. 5*e*, that the wire 15 of the cable 14 is shorted to a positive voltage source for some reason so that current always is flowing on wire 15 back to the timing capacitor 59 maintaining it charged at Vt at all times. Thus the timing counter 63 is virtually never able to count, as indicated by te, since the timing capacitor 59 is always at the high voltage Vt with the result that the count output on line e of the latch decoder 70 is in the range of (0–5).

It should now be clearly understood that the timing capacitor 59 is thus charged in accordance with the RC time constant of the resistive network 35 to a predetermined threshold or clamping level Vt as determined by zener diode 37. Inasmuch as the timing counter 63 starts to count at the same time the timing capacitor 59 starts to charge, at the instant that the voltage on the positive input of the comparator circuit 61 is higher than the voltage on the negative input thereof, the output 69 of the comparator circuit 61 swings high and causes the timing counter 63 to stop counting the pulses received from the 1000 Hz oscillator 67. Then upon receipt of the leading edge of control pulse 44, the latch decoder 70 is latched with the count in the timing counter 63 and simultaneously the timing counter 63 is reset to zero. The latch decoder 70 thus decodes the count to provide the output count, and, depending on the range in which this count output is in, it causes one of the range outputs of the latch decoder 70 to swing to a high potential indicative of the status condition of a zone.

Note that the zone counter/decoder 23 in the central controller 13 is provided with a reset input 28 and a clock input 29 on which the synchronizing and address pulse 55 and 56 are applied in a manner similar to the counter/decoder 34 in each of the zone transponders 17, as previously described. Thus the zone counter/decoder 23 in the central controller 13 is reset and incremented along with the counter/decoder 34 in each of the zone transponders 17 in response to each address pulse. However, whereas each counter/decoder 34 in the zone transponders 17 is only programmed to supply one count output, indicative of the address of its zone transponder 17, the zone counter/decoder 23 in the central controller 13 provides an output for each of the ten transponders 17 to let the central controller 13 know which zone transponder 17 is sending a status signal back from its zone sensor 30. Thus, as each analog signal is converted in the analog-to-digital converter 21 into a digital signal indicative of the status condition of the addressed zone transponder, the zone counter/decoder 23 in the controller 13 provides for identifying that information or data so that it can be stored in one of the zone status registers 22 that is provided in the central controller 13 for that zone.

The zone data count stored in the zone status register 22, if in a range other than count (41–80), which indicates the zone is good, is fed into an "or" circuit 73 having an output which is sequentially connected to an LED 76 associated with each of the ten zones, as provided on a zone status display 24. Thus, upon sensing a zone, if the output of the latch decoder 70 is in the range of count (41–80), the LED 76 for that zone will not be lit indicating that the zone is good and there is nothing to be concerned about. However, if the LED 76 for a zone goes on, as a result of an output count of the timing counter 63 being in one of the other output count ranges of the latch decoder 70 that are provided for, resulting in an output on "or" circuit 73, that indicates that the zone is reporting a bad zone. Now this bad reporting may be due to either an actual intrusion, as indicated by the opening of the normally-closed sensor switch 53, or due to a malfunctioning of the circuits at the zone. In order to determine whether it is indeed an intrusion or merely one of the three malfunctioning conditions, LEDs 77, 78 and 79 are inserted in the lines connected to the output ranges of the latch decoder 70 which are indicative of these three malfunctioning conditions as found on output lines a, d, and e of the latch decoder 70. For example, assume that upon addressing zone 3, the LED 76 lights up for zone 3 in the zone status display 24. By observing the malfunctioning lights it is noted that LED 78 is lit. This indicates that zone 3 has not been intruded upon by the opening of the sensor normally-closed switch 58 but, rather, that the sensor 30 in path 51 of network 35 has been shorted for some reason. Thus, by observing these lights the observer at the central controller 13 is able to actually know whether the light on the display indicates the switch 53 has been opened or whether the light indicates a malfunctioning, and, if so, what the nature of the malfunctioning is.

Reference will next be made to FIG. 6 which shows a modified form of a resistive network 54 that could be used in place of the resistive network 35 shown in each of the ten zone transponders 17 in FIG. 3. Thus the resistive network 54 provides for using a detecting sensor 58 which includes a normally-open switch 53*a* and a supervisory resistor R4 connected in parallel thereacross. Thus resistive network 54, similarly to that in resistive network 35, includes a first path 50 containing resistor R2, but the second path 60 in this network 54 includes a resistor R3 connected in series with a sensor 58 comprising a normally-open switch 53*a* having a supervisory resistor R4 connected in parallel thereacross. The resistors R2, R3 and R4 in this network 54 may be of the same value as the corresponding resistors in network 35. However, it should now be clear that current flow through the resistive network 54 differs for the different status conditions as previously described in FIGS. 5*a*–5*e* for network 35. However, nevertheless, having once determining what the current flow is for each status condition, and the range of the counts therefor in the timing counter 63, it is possible to simply change the wiring of the latch decoder 70 so as to have it sense ranges of count outputs corresponding to each of these status conditions. It should be further noted that the sensor 58 in FIG. 6 could be replaced by a detecting device having a resistance that varies as a function of a change in temperature or pressure and thereby affects the current flow in the resistive network.

Reference will next be made to FIG. 7 which shows an alternate embodiment of the central controller 13 for the intruder detection system 11 of the present invention wherein a programmed microprocessor 80 of the type MC 146805 manufactured by Motorola may be utilized to perform many of the functions performed by the discrete circuits in the central controller 13, as indicated in FIG. 1. Thus, the microprocessor 80 can be programmed to perform the functions of the 100 Hz oscillator, the pulse generator 19, the analog-to-digital converter 21 including the timing counter 63 and the zone counter/decoder 23, and the zone status memory registers 22. Thus, when such a programmed microprocessor is employed, the only additional equipment needed, besides the power supply 41, is the 1000 Hz oscillator 67, the power amplifier 20, the gate 27, the zener diode 37, the timing capacitor 59, the comparator circuit 61, the adjustable potentiometer 62 needed to set the input of the comparator circuit 61, and the zone status display 24.

While the detection system shown and described herein is admirably adapted to fulfill the objects and advantages previously mentioned as desirable, it is to be understood that the invention is not limited to the specific features shown and described but that the means and configurations herein disclosed are susceptible of modification in form, proportions and arrangement of parts without departing from the principles involved or sacrificing any of its advantages and the invention, therefore, may be embodied in various forms within the scope of the appended claims.

What is claimed is:

1. A multiple-zone intrusion detection system comprising:

a central controller;

a plurality of remote zone transponders;

a two-wire communication cable interconnecting said central controller and said plurality of zone transponders;

said central controller including pulse generating means for applying address pulses on said communication cable for supplying power to and sequentially addressing said zone transponders thereby causing each of said zone transponders to transmit an analog signal on said communication cable back to said central controller; and an analog-to-digital converter at said central controller for converting said analog signal to a digital signal indicative of the status of an addressed zone transponder.

2. A multiple-zone intrusion detection system comprising:

a central controller;

a plurality of remote zone transponders;

a two-wire communication cable interconnecting said central controller and said plurality of zone transponders;

said central controller including a pulse generating means, a power amplifier and a gate;

said pulse generating means generating a series of control pulses and a series of address pulses;

said power amplifier providing for amplifying said address pulses and passing them onto said communication cable when said gate is enabled by said control pulses to supply power to and sequentially address said zone transponders thereby causing said zone transponders to individually transmit an analog current signal on said communication cable back to said central controller; and an analog-to-digital converter at said central controller for receiving said analog current signal from an addressed zone transponder when said gate is disabled by the absence of a control pulse to convert said analog current signal to a digital signal indicative of the status of said addressed zone transponder.

3. A multiple-zone intrusion detection system as defined in claim 2 wherein the periods between successive address pulses are defined as polling intervals;

wherein said control pulses are located relative to said address pulses for enabling said gate to connect said power amplifier to said communication cable during the first portion of each polling interval and for disabling said gate to disconnect said power amplifier from said communication cable during the last portion of each polling interval;

whereby an analog current signal from an addressed zone transponder can be transmitted on said communication cable back to said analog-to-digital converter for conversion to a digital signal indicative of the status of said zone transponder during said last portion of each polling interval.

4. A multiple-zone intrusion detection system comprising:

a central controller;

a plurality of remote zone transponders;

a two-wire communication cable interconnecting said central controller and said plurality of zone transponders;

said central controller including a pulse generating means, a low impedance power amplifier, a gate, and a timing capacitor;

each said zone transponder including a power capacitor, a counter/decoder and a resistive network including a sensor;

said pulse generating means generating control pulses and address pulses, the periods between succession address pulses being defined as polling intervals;

said power amplifier providing for amplifying said address pulses and passing them onto said communication cable when said gate is enabled by said control pulses for charging said power capacitors and incrementing said counter/ decoders for sequentially addressing each of said zone transponders to apply the voltage on its power capacitor to its resistive network thereby causing a response current to be transmitted on said communication cable back to said central controller to charge said timing capacitor when said gate is disabled; and means for determining the time required for said response current to charge said timing capacitor to a predetermined voltage level.

5. A multiple-zone intrusion detection system as defined in claim 4 wherein said gate is enabled during the first half of a polling interval to connect said low impedance power amplifier to permit the timing capacitor to discharge through said gate into said power amplifier.

6. A multiple-zone intrusion detection system as defined in claim 4 wherein said timing capacitor is discharged during the first half of a polling interval through the enabled gate into the power amplifier and is charged during the last half of a polling interval by the response current flowing on the cable from the resistive network of the addressed zone transponder.

7. A multiple-zone intrusion detection system comprising:

a central controller;

a plurality of remote zone transponders;

a two-wire communication cable interconnecting said central controller and said plurality of zone transponders;

said central controller including;

a pulse generating means for generating control pulses and address pulses, the periods between successive address pulses being defined as polling intervals;

a low impedance power amplifier for amplifying said address pulses;

a gate;

a timing capacitor connected to said cable;

a comparator having a positive input connected to said timing capacitor and having a negative input connected to a fixed voltage;

a source of timing pulses;

a timing counter connected to count said timing pulses;

each said zone transponders including:

a power capacitor;

a counter/decoder; and a resistive network including a detecting sensor;

said control pulses controlling said gate to connect said power amplifier to said cable to supply power address pulses thereon to charge said power capacitors and to increment said counter/decoders to thereby sequentially address said zone transponders to cause the voltage on the power capacitor of an addressed zone transponder to energize the resistive network thereof to transmit current on said cable back to said central controller during a polling interval;

said control pulses controlling said gate during the first half of each polling interval to connect said power amplifier to said cable to discharge said timing capacitor and to discharge the current from the resistive network, and controlling said gate during the last half of each polling interval to disconnect said power amplifier from said cable to enable current received from said resistive network to charge said timing capacitor and to enable said timing counter to count said timing pulses;

said comparator providing for stopping said timing counter when the voltage of the timing capacitor of the positive input of said comparator exceeds the voltage on the negative input thereof to provide a count thereon indicative of the status of the detecting sensor of each said addressed zone transponders.

8. A multiple-zone intrusion detection system as defined in claim 7 wherein said central controller includes a latch decoder which is enabled by said control pulses to be set in accordance with the count in said timing counter simultaneously with the resetting of said timing counter to zero at the end of each polling interval.

9. A multiple-zone intrusion detection system as defined in claim 8 wherein said latch decoder provides for a range of output counts to be provided at each of a plurality of outputs thereof, each range corresponding to a particular status of a zone.

10. A multiple-zone intrusion detection system as defined in claim 9 wherein said detecting sensor is a switch; and ranges of output counts are provided from said latch decoder for indicating a zone closed sensor switch, a zone open sensor switch, a shorted zone sensor, a shorted zone cable, and a non-operational zone transponder.

11. A multiple-zone intrusion detecting system as defined in claim 8 wherein a zone counter/decoder is provided at said central controller which is incremented by the address pulses on said cable to provide outputs identifying each of the addressed zone transponders; and zone status registers are provided at said central controller for storing the outputs of said latch decoder corresponding to the status of each addressed zone transponder.

12. A multiple-zone intrusion detection system as defined in claim 11 wherein a zone status display is provided with an indicator light for displaying the status of each zone as stored in said zone status register, and wherein if the status of a zone is good the indicator light for the zone remains unlit, and if the status of the zone is bad, either due to an intrusion or a malfunctioning, the indicator light is lit.

13. A multiple-zone intrusion detection system as defined in claim 12 wherein the malfunctioning and intrusion statuses of a zone are all fed into an "or" circuit having its output connected to the zone indicator light on the zone status display, and each malfunctioning status is provided with a separate indicator light, whereby if a zone indicator light on the zone status display is lit, the separate malfunctioning indicator lights will indicate whether it is a malfunctioning status and the nature of the malfunctioning.

14. A multiple-zone intrusion detection system as defined in claim 7 including a zener diode connected between the output of said power amplifier and said cable, said zener diode providing for bypassing said gate and thereby clamping the voltage on said timing capacitor to a threshold voltage level which is below the voltage level that will erroneously increment any of said counter/decoders in said zone transponders during the last half of said polling interval.

15. A multiple-zone intrusion detection system as defined in claim 7 wherein said control pulses and said address pulses are square wave pulses with the leading edge of a control pulse aligned with a leading edge of an address pulse and with the trailing edge of the control pulse located substantially in the middle of the polling interval.

16. A multiple-zone intrusion detection system as defined in claim 15 wherein said counter/decoders in said zone transponders are incremented by the leading edge of each square wave address pulse.

17. A multiple-zone intrusion detection system as defined in claim 16 wherein said timing capacitor starts to be charged by current flowing back from the resistive network of an addressed zone transponder and said timing counter simultaneously starts to count the timing pulses generated by said high frequency oscillator at the trailing edge of each square wave control pulse.

18. In a communication system for transmitting information from a plurality of remote locations to a central location over a common communication cable;

a plurality of zone transponders each connected to said common communication cable at a different one of said remote locations;

control means at said central location including pulse generating means for generating a series of control pulses and a series of address pulses for transmission over said communication cable to said remote locations;

the time period between the end of each address pulse and the beginning of the following address pulse defining a polling interval;

gating means enabled by each control pulse generated by said pulse generating means to apply a separate address pulse on said communication cable for each of said zone transponders to thereby define an individual response polling interval for each zone transponder;

each of said zone transponders including a resistive network having a sensor therein and a counter/decoder means responsive to a different number of said address pulses to energize its resistive network to provide a response current signal during a polling interval for transmission over said communication cable to said central location; and receiver circuit means at said central location for receiving said response current signal during a portion of said polling interval when said gating means is not enabled by a control pulse and converting said current signal to a digital signal indicative of the operational status of said zone transponder.

19. In an intrusion detection system for controlling communication on a single two-wire cable between a central controller and a plurality of remote zone transponders.

a resistive network including a sensor switch and a power capacitor at each of said zone transponders;

a pulse generator at said central controller for generating control pulses and address pulses;

the periods between successive address pulses defining polling intervals;

a low impedance power amplifier at said central controller for amplifying the address pulses generated by said pulse generator;

a gate at said central controller controlled by said control pulses to pass address pulses provided by said power amplifier on said cable for use in supplying power to said power capacitor and sequentially rendering each of said zone transponders individually operable to cause current to flow during a polling interval through its resistive network onto the cable back to the central controller;

a timing capacitor at said central controller connected to said cable;

each said control pulse further providing for enabling said gate during the first portion of each polling interval to discharge said timing capacitor into the low impedance of said power amplifier and disabling said gate during the last portion of each polling interval to charge said timing capacitor with current from the resistive network of an operable zone transponder; and means for sensing the time required to charge said timing capacitor to a determined voltage level with current from the resistive network of an addressed zone transponder to thereby provide an indication of the sensor switch therein.

20. In an intrusion detection system as defined in claim 19 wherein the resistive network in each of said zone transponders comprises:

an input lead including a switching means to which the output voltage of the associated power capacitor is applied when the zone transponder of which it is a part is addressed;

an output lead connected to said cable;

a first current path including a first resistor connecting said input lead to said output lead; and a second current path including in series a second resistor, a normally closed switch and a supervisory resistor connecting said input lead to said output lead in parallel with said first current path.

21. In an intrusion detection system as defined in claim 19 wherein the resistive network in each of said zone transponders comprises:

an input lead including a switching means to which the output voltage of the associated power capacitor is applied when the zone transponder of which it is a part is addressed;

an output lead connected to said cable;

a first current path including a first resistor connecting said input lead to said output lead; and a second current path including a second resistor in series with a normally open switch having a supervisory resistor connected in parallel therewith connecting said input lead to said output lead in parallel with said first current path.

* * * * *